US005480299A

United States Patent [19]

Motomura et al.

[11] Patent Number: 5,480,299

[45] Date of Patent: Jan. 2, 1996

[54] HIGH-TEMPERATURE GAS BLOWER IMPELLER WITH VANES MADE OF DISPERSION-STRENGTHENED ALLOY, GAS BLOWER USING SUCH IMPELLER, AND GAS CIRCULATING FURNACE EQUIPPED WITH SUCH GAS BLOWER

[75] Inventors: Yoshitada Motomura, Toyota; Hiroshi Tawara, Nagoya; Kenji Tsukuta, Gifu; Tomohito Iikubo, Nagoya, all of Japan

[73] Assignee: Daido Tokushuko Kabushiki Kaisha, Nagoya, Japan

[21] Appl. No.: 281,071

[22] Filed: Jul. 27, 1994

Related U.S. Application Data

[62] Division of Ser. No. 110,949, Aug. 24, 1993.

[51] Int. Cl.[6] ..... F27B 3/22

[52] U.S. Cl. ..... 432/176; 416/241 R; 416/241 B; 432/59; 432/121; 417/420

[58] Field of Search ..... 416/241 R, 241 B; 432/59, 121, 176; 417/420

[56] References Cited

U.S. PATENT DOCUMENTS 5,310,431 5/1994 Buck ..... 148/325

*Primary Examiner*—Henry A. Bennett
*Assistant Examiner*—Siddharth Ohri
*Attorney, Agent, or Firm*—Oblon, Spivak, McClelland, Maier & Neustadt

[57] ABSTRACT

An impeller for a high-temperature gas blower suitable for a floating conveyor furnace, having vanes each formed of a dispersion-strengthened alloy which includes as a disperse or internal phase 0.1–2.0% by weight of finely divided particles of an oxide of a high melting-point metal, such as $Y_2O_3$, $Ce_2O_3$, $ZrO_2$, $Al_2O_3$ and $Gd_2O_3$, preferably dispersed in an austenite matrix or external phase of Cr, Fe, Al, Ti and Ni. A gas blower having such impeller, and a furnace using such gas blower are also disclosed.

13 Claims, 8 Drawing Sheets

HIGH-TEMPERATURE GAS BLOWER IMPELLER WITH VANES MADE OF DISPERSION-STRENGTHENED ALLOY, GAS BLOWER USING SUCH IMPELLER, AND GAS CIRCULATING FURNACE EQUIPPED WITH SUCH GAS BLOWER

This is a division of application Ser. No. 08/110,949, filed on Aug. 24, 1993.

BACKGROUND OF THE INVENTION

1. Field of the Invention

The present invention relates in general to a high-temperature gas blower impeller, a gas blower device equipped with such impeller, and a high-temperature gas circulating furnace equipped with such gas blower device, and more particularly to a technique relating to improvements in the material of vanes or blades of the impeller.

2. Discussion of the Related Art

An blower or fan is used to blow a gas of a relatively high temperature in various industrial furnaces such as heat treating and heating furnaces. Such a high-temperature blower is utilized, for example, to stir or circulate a high-temperature atmosphere or gas of around 800° C. within a furnace. Since the blower is used in such severe thermal environment, a rotating impeller of the blower is usually made of a heat-resistant steel capable of withstanding a reaction force and a centrifugal force which are produced during an operation of the blower to circulate the atmosphere.

However, the upper limit of the operating temperature of the impeller made of a heat-resistant steel is about 850° C., above which the impeller does not have a sufficient strength. Also, the strength of the impeller limits the operating speed of the impeller to 1000 r.p.m. or so. To obtain a desired capacity or gas quantity, therefore, the gas blower device must be relatively large-sized. Whereas, it is desired to minimize the size of the gas blower device, particularly where the device is built in a furnace, such as a gas circulating furnace adapted to circulate a high-temperature gas within a heating chamber. In this case, an increase in the size of the blower device will undesirably lead to an accordingly large size of the furnace body.

SUMMARY OF THE INVENTION

It is therefore a first object of the present invention to provide an impeller for a high-temperature gas blower, which is sufficiently heat-resistant and capable of operating at a high rotating speed.

It is a second object of this invention to provide a high-temperature gas blower equipped with an impeller having a sufficiently high heat resistance, which is relatively small-sized and has a large capacity.

It is a third object of the invention to provide a small-sized gas circulating furnace equipped with such small-sized large-capacity high-temperature gas blower device.

The first object may be accomplished according to one aspect of the present invention, which provides an impeller for a high-temperature gas blower, rotated to blow a high-temperature gas, which impeller comprises a plurality of vanes each formed of a dispersion-strengthened alloy which includes as a disperse or internal phase 0.1–2.0% by weight of finely divided particles of an oxide (oxides) of at least one metal whose melting point is high.

The impeller of the present invention exhibits a sufficiently high degree of strength even at a high operating temperature and is operable at a high rotating speed, owing to the use of a dispersion-strengthened alloy for the vanes or blades of the impeller. This alloy includes a disperse or internal phase consisting of 0.1–2.0% by weight of finely divided particles of at least one high-melting point oxide, which are dispersed or distributed in a 99.9–98.0% by weight of a matrix or external phase.

According to one form of the impeller of this invention, the dispersion-strengthened alloy consists of 0.1–2.0% by weight of the disperse phase, 18–40% by weight of chromium (Cr), not more than 5% by weight of iron (Fe), not more than 5% by weight of aluminum (Al), not more than 5% by weight of titanium (Ti) and the balance including nickel (Ni) as a major element. The metal elements Cr, Fe, Al and Ti and the balance constitute an austenite matrix phase in which the finely divided metal oxide particles are dispersed as the disperse phase.

In the above form of the invention, the dispersion-strengthened alloy consists of an alloy obtained by repeated bonding and plastic deformation of particles of the metallic elements Cr, Fe, Al, Ti and Ni and the particles of the metal oxide or oxides, while being subjected to mixing and crushing in a ball mill. In this instance, the vanes may be formed by hot extrusion of the dispersion-strengthened alloy obtained in the above process.

The metal oxide or oxides may be preferably selected from the group consisting of $Y_{23}$, $Ce_2O_3$, $ZrO_2$, $Al_2O_3$ and $Gd_2O_3$.

The second object indicated above may be achieved according to another aspect of this invention, which provides a high-temperature gas blower having an impeller rotated to blow a high-temperature gas, the implementer comprising a plurality of vanes each formed of a dispersion-strengthened alloy which includes as a disperse phase 0.1–2.0% by weight of finely divided particles of an oxide (oxides) of at least one metal having a high melting point.

The present high-temperature gas blower constructed according to the second aspect of the invention can be significantly small-sized while maintaining a sufficiently large capacity, since the impeller used in the present gas blower exhibits a sufficiently high degree of strength under a severe thermal condition and is capable of operating at a high rotating speed, owing to the use of the dispersion-strengthened alloy for the vanes of the impeller.

According to a preferred form of the gas blower of the invention, the impeller further comprises a cylindrical hub fixed to an end portion of a drive shaft driven by an electric motor, and the vanes consist of a plurality of generally elongate plates which are fixed to the hub so as to extend radially of the hub such that the vanes are equally spaced apart from each other in a circumferential direction of the hub.

In the above form of the invention, each generally elongate plate used as a vane of the impeller may have a fixed end portion shaped to have protrusions which protrude away from each other from the planes of opposite major surfaces of the other portion of the each plate, in a direction of thickness of the plate. In this case, the hub has a plurality of grooves corresponding to the generally elongate plates. Each groove has a shape similar to that of the fixed end portion of the plate. The plates are fixed to the hub such that the fixed end portion of each plate is fixedly received in the corresponding groove.

The gas blower may further comprise a cylindrical bearing housing having an annular cooling jacket through which a coolant is circulated, and a pair of bearings supported in the bearing housing, so that the drive shaft is rotatably supported by the pair of bearings such that the drive shaft extends through the bearing housing in an axial direction thereof.

The third object indicated above may be attained according to a further aspect of the present invention, which provides a gas circulating furnace for heat-treating a workpiece by circulation of a high-temperature gas within a heating chamber, comprising: a furnace body having a plurality of walls which cooperate to define the heating chamber; and a high-temperature gas blower disposed so as to extend through one of the walls of furnace body, for circulating the high-temperature gas within the heating chamber. The gas blower includes an impeller having a plurality of vanes each formed of a dispersion-strengthened alloy which includes as a disperse phase 0.1–2.0% by weight of finely divided particles of an oxide of at least one metal having a high melting point.

The present gas circulating furnace constructed as described above can be made small-sized, since the gas blower can be small-sized while maintaining a sufficiently large capacity, as described above, In one form of the gas circulating furnace, the furnace body includes side walls, a bottom wall and a top wall, and the furnace includes a plurality of floaters arranged on the bottom wall of the furnace body, and at least one duct disposed along at least one of the side walls of the furnace body. The floaters have respective nozzles open in the upper surfaces to provide streams of a high-temperature gas for supporting the workpiece in the form of a strip in a non-contact floating fashion, and each duct is connected to the high-temperature gas blower and the floaters. The gas blower operates to compress the high-temperature gas within the furnace body, and deliver the compressed high-temperature gas to the plurality of floaters.

The form of the furnace may further include a plurality of upper nozzle members which are disposed above the respective floaters which function as lower nozzle members. The upper nozzle members have respective chambers connected to the duct or ducts, and also have nozzles open in the lower surfaces. The lower and upper surfaces of the lower and upper nozzle members cooperate to define a feed path of the strip. The strip is supported in the non-contact floating fashion, by the streams of the high-temperature gas provided through the nozzles of the lower and upper nozzle members.

In another form of the circulating furnace according to the present invention, the furnace body includes a stationary bottom wall, and a movable box structure which consists of side walls and a top wall and which cooperates with the stationary bottom wall to define the heating chamber. The movable box structure is placed on and removed from the bottom wall when the furnace is loaded and unloaded with the workpiece. The high-temperature gas blower is fixed to the bottom wall so as to extend therethrough.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which.

DETAILED DESCRIPTION OF PREFERRED EMBODIMENTS

Figure 1:
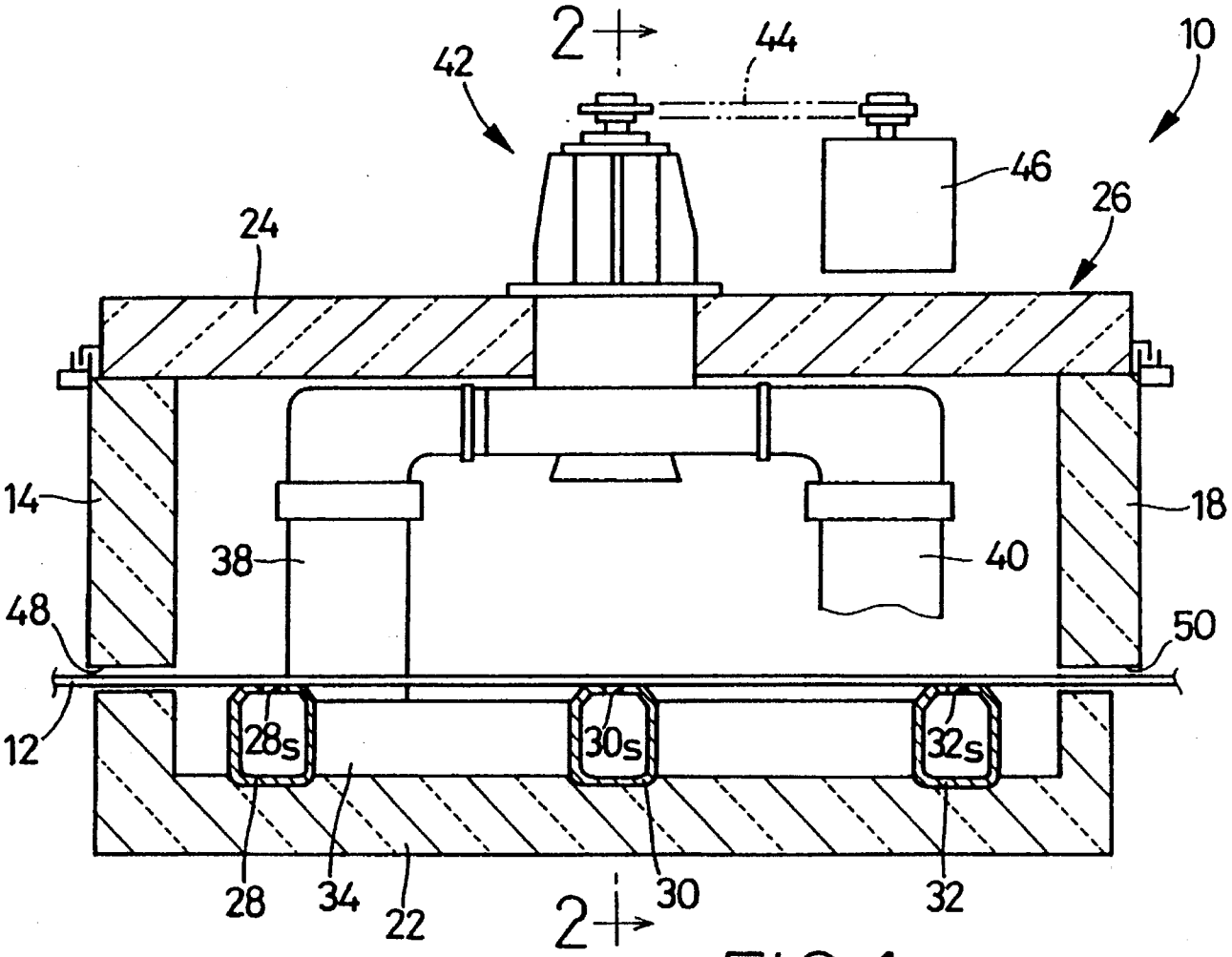
FIG. 1 is an elevational view in longitudinal cross section of a gas circulating furnace in the form of a floating conveyor furnace constructed according to one embodiment of the present invention, which view is taken along line 1—1 of FIG. 2.
Figure 2:
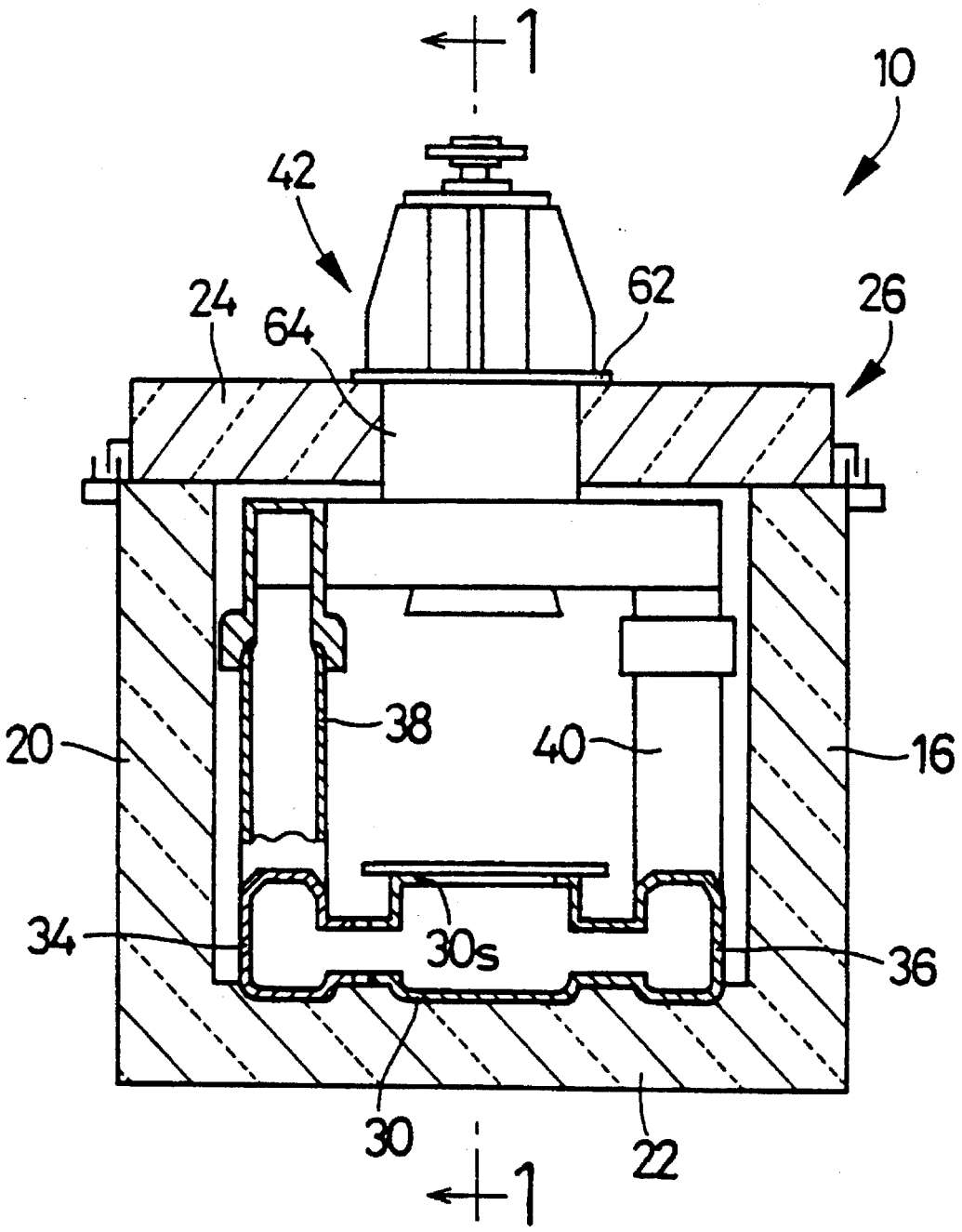
FIG. 2 is an elevational view in transverse cross section taken along line 2—2 of FIG. 1.

Referring first to the longitudinal and transverse cross sectional views of FIGS. 1 and 2, a floating conveyor furnace is generally indicated at 10. The floating conveyor furnace 10 is adapted to effect heat treatment of a workpiece in the form of a strip 12 made of silicon steel, copper, copper alloy or aluminum, for example. More specifically described, the furnace 10 is arranged to feed or convey the strip 12 along a feed path through the furnace 10, in a non-contact or floating fashion, and heat the strip 12 within a controlled atmosphere or gas within the furnace 10 while the strip 12 is fed therethrough. This floating conveyor furnace 10 is effective particularly where the strip 12 to be heat-treated is formed of copper, copper alloy, aluminum or other soft material and is required to have a high degree of glossiness after the heat treatment. For instance, the furnace 10 is used as part of a heat-treating line such as an annealing line, a hardening line, a de-greasing or de-oiling line, a paint drying line and a baking line. The furnace 10 is equipped with a heat source as as gas burners, radiant tube burners and electric heaters.

The floating conveyor furnace 10 uses a furnace body 26 having a heating chamber defined by four side walls 14, 16, 18, 20, a bottom wall 22 and a top wall 24. The side walls 14, 16, 18, 20 and the bottom wall 22 are integrally formed so as to define a rectangular box structure with an open end closed by the top wall 24. The furnace 10 includes a three floaters 28, 30, 32 placed on the bottom wall 22 such that the floaters are spaced apart from each other in the feeding direction of the strip 12, and extend parallel to each other in the direction perpendicular to the feeding direction of the strip 12. The three floaters 28, 30, 32 communicate with each other through a pair of horizontal ducts 34, 36, which are connected to the opposite ends of each floater 28, 30, 32, as shown in FIG. 2. These horizontal ducts 34, 36 extend along and adjacent the opposite side walls 16, 20. The horizontal ducts 34, 36, are connected to a pair of vertical ducts 38, 40, which extend upright toward the top wall 24. The vertical ducts 38, 40 communicate at their upper ends with a gas blower in the form of a circulating fan generally indicated at 42 in FIGS. 1 and 2. The circulating fan 42 is supported by the top wall 24 such that the fan 42 extends through the top wall 24. The fan 42 is equipped with an electric motor 46 and a chain belt 44 connected to the motor 46.

The floaters 28, 30, 32 have respective nozzles in the form of air slits **28*s*, 30*s*, 32*s* open in the upper surfaces, so that streams of a compressed gas delivered from the circulating fan 42 are blown through the air slits 28*s*, 30*s*, 32*s*. The streams of the compressed gas act on the strip 12 so as to support the strip 12 in a non-contact or floating fashion within the heating chamber of the furnace body 26. The strip 12 supported by the floaters 28, 30, 32 within the furnace body 26 is continuously fed therethrough, by suitable drive rolls as well known in the art, from an inlet 48 toward an outlet 50. The inlet and outlet 48, 50 are formed through the opposite side walls 14, 18, respectively, as shown in FIG. 1**.

Figure 3:
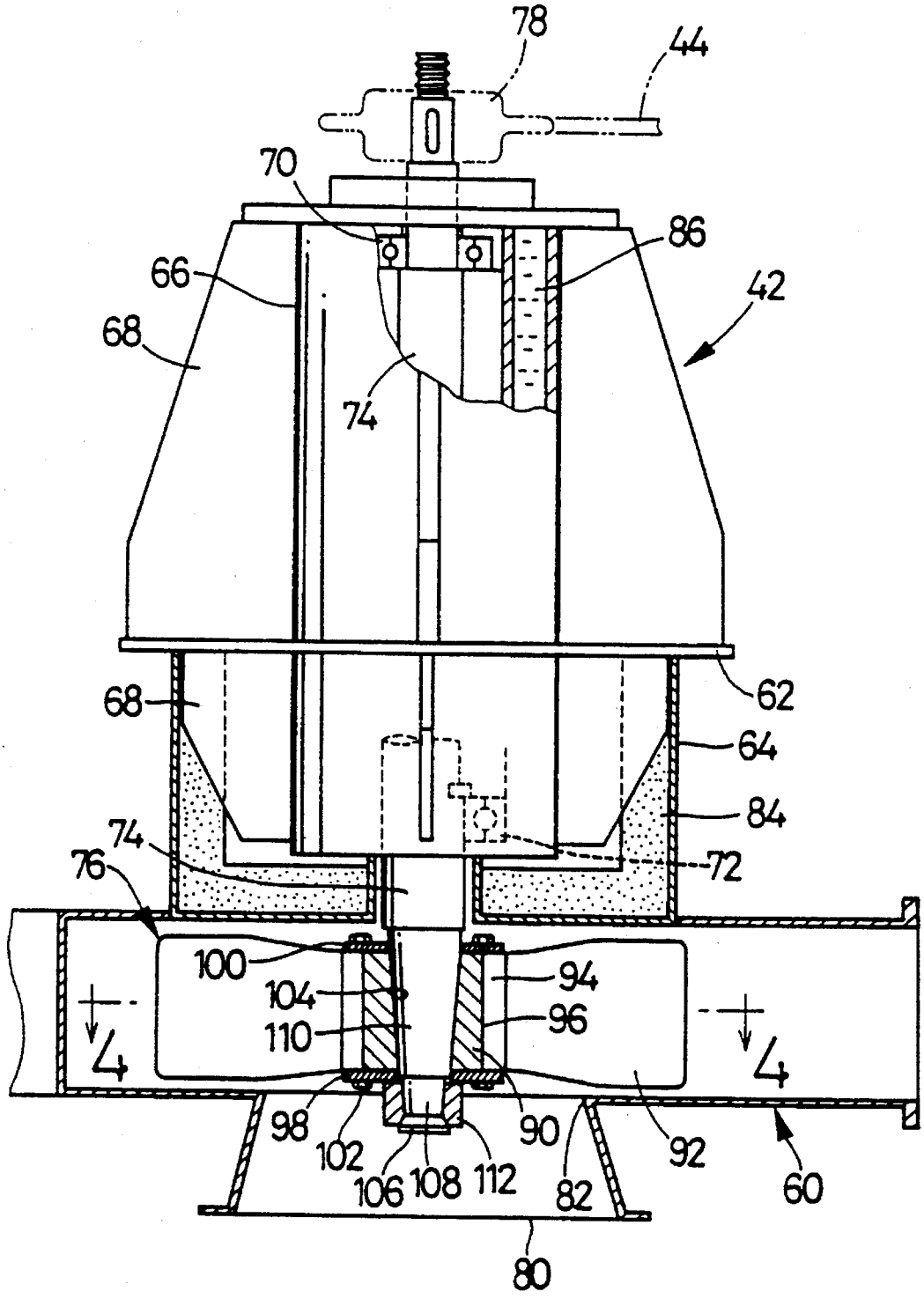
FIG. 3 is an enlarged front elevational view partly in cross section showing a gas blower in the form of a circulating fan used in the furnace of FIGS. 1 and 2.

Reference is now made to FIG. 3, the gas blower in the form of the circulating fan 42 has a casing 60 positioned within the furnace body 26 and communicating with the vertical ducts 38, 40. The casing 60 has a generally circular shape as seen in the direction from the bottom wall 22 toward the top wall 24. The fan 42 also has a heat-insulating sleeve 64 which extends through the top wall 24 and carries the casing 60 fixed at its lower end. The sleeve 64 has a flange plate 62 at its upper end, which is held in contact with the upper surface of the top wall 24, as shown in FIG. 2. The heat-insulating sleeve 64 receives a lower portion of a cylindrical bearing housing 66. This bearing housing 66, which has a smaller diameter than the sleeve 64, is secured to the flange plate 62 by a plurality of reinforcing plates 68. Upper and lower bearings 70, 72 are supported within the bearing housing 66, such that the two bearings 70, 72 are spaced apart from each other in the axial direction of the bearing housing 66. The bearings 70, 72 rotatably support a drive shaft 74, whose upper end portion projects above the upper end of the bearing housing 66, and whose lower end portion extends through the casing 60 indicated above. The drive shaft 74 carries an impeller 76 fixed at its lower end portion, and a sprocket wheel 78 fixed at its upper end portion outside the bearing housing 66. The drive shaft 74 is rotated by the electric motor 46 through the chain belt 44 and the sprocket wheel 78.

The casing 60 has a central opening 82 formed through its lower surface, and is provided with a frusto-conical intake hood 80 fixed to the edge of the opening 82. With the impeller 76 rotated within the casing 60, a high-temperature gas within the furnace body 26 is sucked into the casing 60 through the hood 80 and opening 82. The gas introduced into the casing 60 is more or less compressed, and delivered to the floaters 28, 30, 32 through the vertical ducts 38, 40 and horizontal ducts 34, 36. The heat-insulating sleeve 64 accommodates a heat-insulating or adiabatic material 84 adjacent its cylindrical wall and in its bottom portion located within the furnace body 26. The adiabatic material 84 thermally insulates the bearing housing 66, to protect the bearings 70, 72 from heat. The bearing housing 66 has a double-wall structure including an outer and an inner cylindrical wall which cooperate to define an annular cooling jacket 86 through a coolant such as water is circulated by a suitable coolant supply device. The cooling jacket 86 also functions to thermally insulate the bearings 70, 72.

Figure 4:
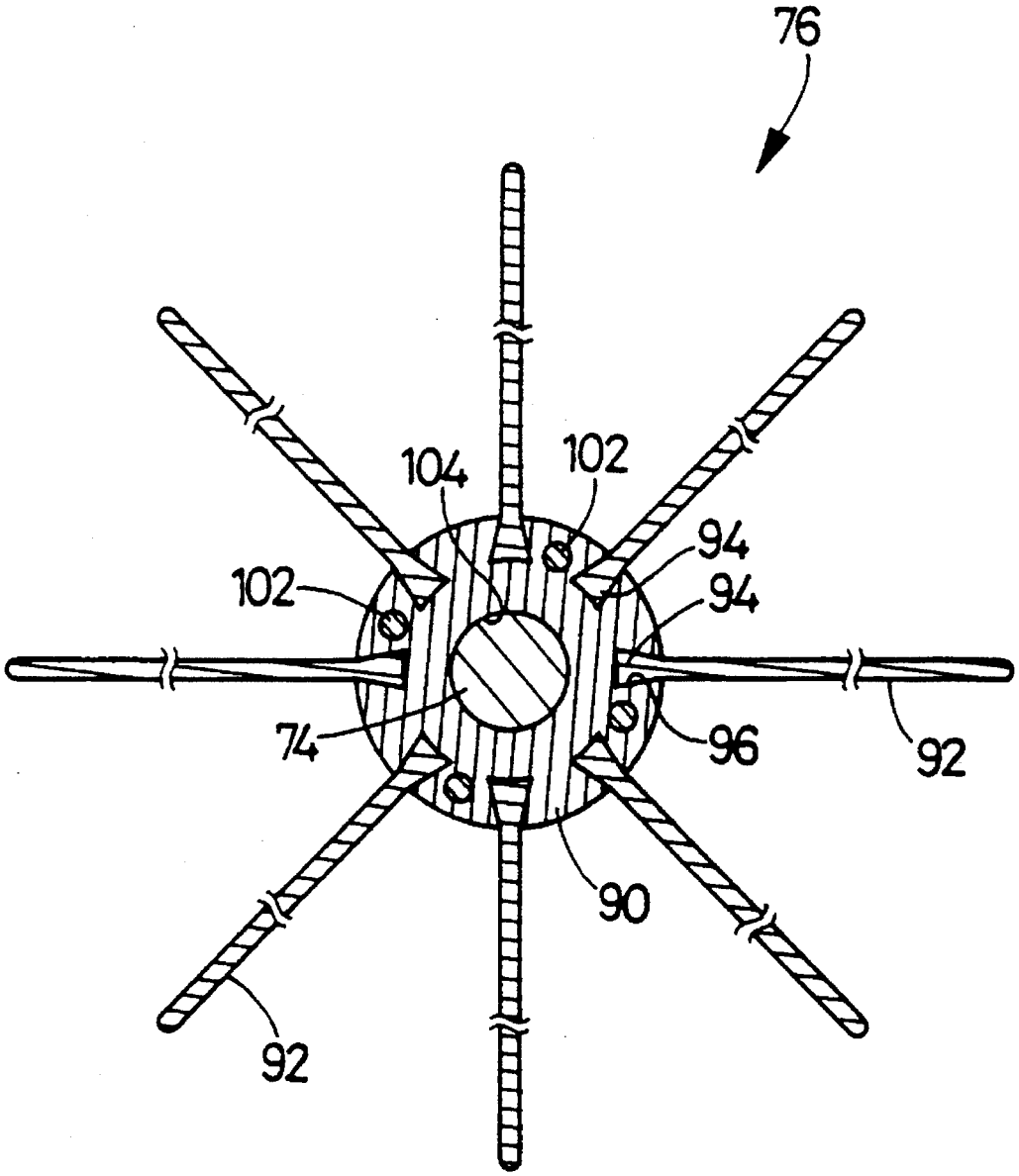
FIG. 4 is a cross sectional view of an impeller of the gas blower of FIG. 3.

The impeller 76 has a cylindrical hub 90 and a radial array of eight vanes or blades 92, as shown in FIG. 4. The hub 90 is made of a heat-resistant steel and fixed to the drive shaft 74. The vanes 92 are generally elongate plates which are fixed to the hub 90 such that the vanes 92 extend radially outwardly of the hub 90 and are equally spaced from each other in the circumferential direction of the hub 90. Each vane 92 has a fixed end portion 94 having a frusto-conical or dovetail shape with the extreme end having the largest thickness. In other words, the fixed end portion 94 has opposite protrusions which protrude away from each other from the planes of the opposite major surfaces of the other portion of the vane or plate 92, in the direction of thickness of the plate 92. The hub 90 has eight dovetail grooves 96 formed in its circumferential surface so as to extend in the axial direction thereof, such that the grooves 96 are equally spaced from each other in the circumferential direction of the .hub 90. Each dovetail groove 96 has a dovetail shape similar to that of the fixed end portion 94, so that the fixed end portion 94 of the corresponding elongate plate or vane 92 is received in the dovetail groove 96. The vanes 92 are held in position by two retainer rings 98, 100 which are forced against the opposite end faces of the hub 90 by bolts 102. The retainer rings 90, 100 and the bolts 102 are made of suitable heat-resistant steels.

The hub 90 has a tapered center bore 104, while the lower end portion of the drive shaft 74 which extend through the casing 60 includes a head portion 106, a first tapered portion 108 and a second tapered portion 110 that are formed in the order of description from the extreme end of the shaft 74. The first tapered portion 108 has a smaller diameter than the head portion 106, and the second tapered portion 110 has a larger diameter than the first tapered portion. The drive shaft 74 is connected to the hub 90 such that the second tapered portion 110 engages the tapered center bore 104 while a split clamp 112 is fitted on the first tapered portion 108. The split clamp 112 consists of two semi-circular members prepared by cutting an annular heat-resistant steel member into two halves. For clamping the drive shaft 74, the two semi-circular members of the split clamp 112 mounted on the first tapered portion 108 are fixed to each other by heat-resistant bolts.

Figure 5:
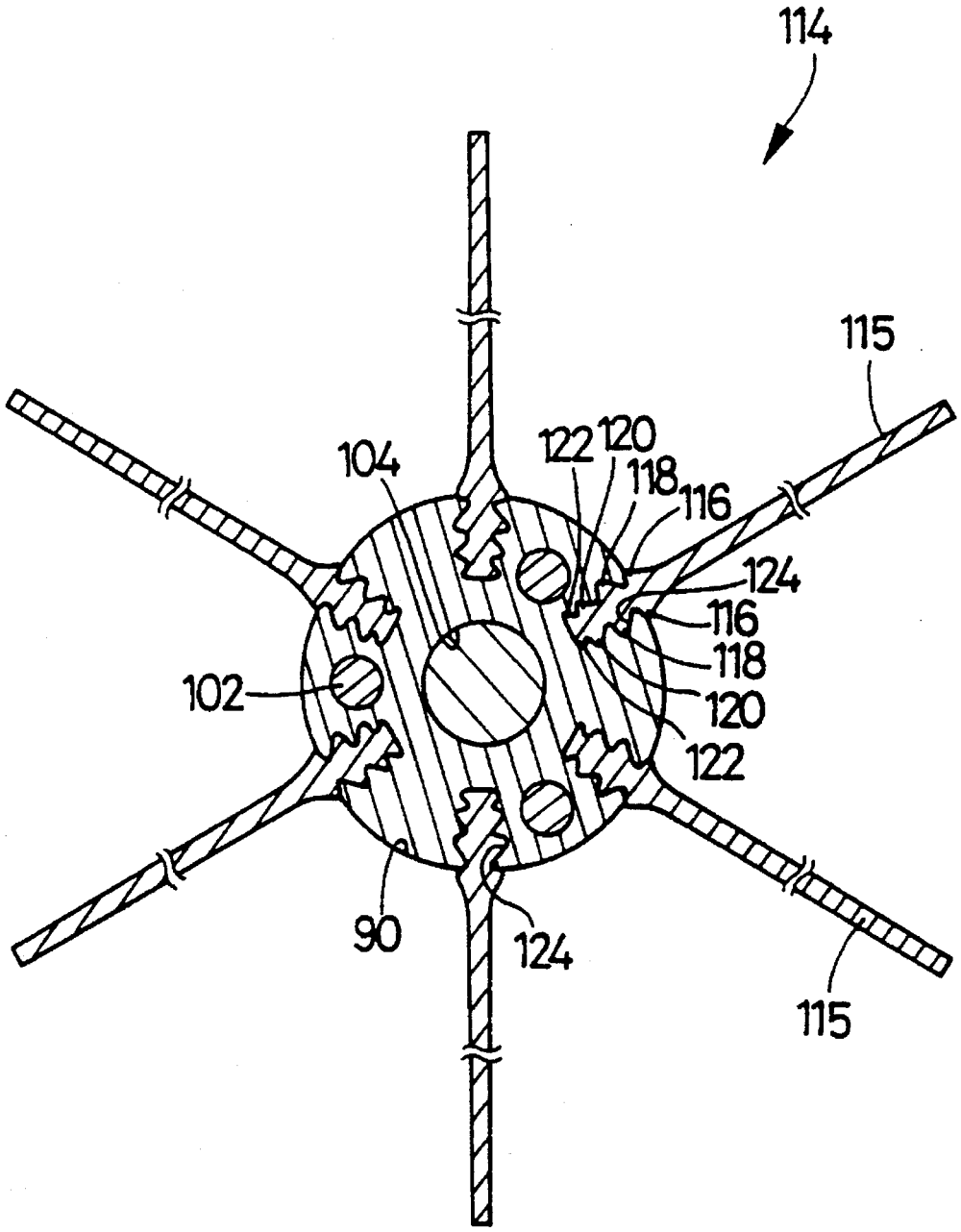
FIG. 5 is a view corresponding to that of FIG. 4, showing a modified impeller according to another embodiment of the present invention.

Referring to FIG. 5, there is illustrated another form of an impeller 114 used in place of the impeller 114 of FIG. 4, according to a second embodiment of the invention. This impeller 114 has a radial array of six vanes 115. The fixed end portion of each vane 115 has a basic thickness which increases in the direction toward the extreme end. The fixed end portion is formed with four successive pairs of barbs 116, 118, 120, 122 each pair consisting of two opposite protrusions which protrude away from each other in the direction of thickness of the vane 115, from the planes of the opposite major surfaces of the vane 115. The first and second pairs of barbs 116, 118 are relatively distant from the extremity of the fixed end portion of the vane 115 have substantially the same amount of protrusion, and the third pair of barbs 120 has a smaller amount of protrusion than the first and second pairs 116, 118. The fourth pair of barbs 122 formed at the extreme end of the vane 115 has the smallest amount of protrusion. In this second embodiment, the hub 90 has six grooves 124 each formed so as to extend in the axial direction thereof. Each groove 124 has a shape similar to that of the barbed fixed end portion of each vane 115, so that the latter is received in the former. Described more specifically, the fixed end portion of the vane 115 engages the groove 124 such that the second, third and fourth pairs of bars 118, 120, 122 are entirely received in the groove 124 while the first pair of barbs 116 merely contact a portion of the outer circumferential surface of the hub 90, which is adjacent to the edge of the groove 124. The vane 115 whose fixed end portion has the increasing thickness and the four successive pairs of barbs provides increased strength of fixing to the hub 90, and improved fatigue resistance, as compared with the vane 92 of FIG. 4 used in the first embodiment.

The vanes 92, 115 are formed of a dispersion-strengthened alloy which consists of an austenite matrix or external phase including suitable amounts of chromium (Cr), iron (Fe), aluminum (Al) and titanium (Ti), and a disperse or internal phase consisting of finely divided particles of an oxide or oxides of a metal or metals having a high melting point, which are dispersed or distributed in the austenite matrix phase. The dispersion-strengthened alloy should include the disperse phase in an amount ranging from 0.1% to 2.0% by weight. One or more metal oxides are selected from the group consisting of $Y_2O_3$, $Ce_2O_3$, $ZrO_2$, $Al_2O_3$ and $Gd_2O_3$. A preferred form of the dispersion-strengthened alloy consists of 0.1–2.0% by weight of finely divided particles of a metal oxide or oxides (as the disperse or internal phase) as indicated above, 18–40% by weight of Cr, not more than 5% by weight of Fe, not more than 5% by weight of Al, not more than 5% by weight of Ti and the balance which includes Ni as a major component or consists essentially of Ni. The metal elements Cr, Fe, Al, Ti and the balance constitute an austenite matrix or external phase in which the metal oxide particles are dispersed as the disperse or internal phase. The balance may include not more than 5% by weight of cobalt (Co).

If the content of the metal oxide or oxides is less than 0.1%, the stability of the dispersion-strengthened alloy at an elevated temperature is not sufficiently high. The effect of the metal oxide or oxides to improve the high-temperature stability of the alloy will be reduced as the metal oxide content exceeds 1%, and is saturated at the content exceeding 2%. An experiment showed a best result when $Y_2O_3$ is used as the disperse phase of the dispersion-strengthened alloy. If the impeller 76, 114 is used in a heat treating furnace for relatively low temperature applications (around 1200° C.), however, $Y_2O_3$ may be partially or totally replaced by $Ce_2O_3$, $ZrO_2$, $Al_2O_3$ and $Gd_2O_3$. It is needless to say that two more more metal oxides are selected from among $Y_2O_3$, $Ce_2O_3$, $ZrO_2$, $Al_2O_3$ and $Gd_2O_3$. In this respect, it is noted that the use of an oxide of tungsten (W) or molybdenum (Mo) is easily thermally decomposed and deteriorates the thermal stability of the dispersion-strengthened alloy.

For assuring sufficient heat resistance of the dispersion-strengthened alloy or the vanes 76, 114, the alloy should include at least 18% by weight of chromium (Cr). However, the content of Cr is preferably 40% or less because the matrix phase tends to encounter difficulty in maintaining an austenite state when the Cr content exceeds 40%. Iron (Fe) is also an element essential to assure excellent heat resistance of the alloy. However, the oxidation resistance of the alloy is deteriorated with the Fe content exceeding 5%. Aluminum (Al) and titanium (Ti) are also essential elements for improved heat resistance of the alloy, but the inclusion of these elements in an amount exceeding 5% by weight will increase the amounts of large-sized particles of precipitates $Al_2O_3$ and $TiO_2$, which are harmful to the maintenance of sufficiently high strength of the alloy.

The dispersion-strengthened alloy usable for the vanes 92, 115 of the impeller 76, 114 is produced by a mechanical alloying process (so-called "MA process"). Described in detail, 18–40% by weight of chromium powder, not more than 5% by weight of iron powder, not more than 5% by weight of aluminum powder, not more than 5% by weight of titanium powder, 0.1–2.0% by weight of metal oxide powder, and powder of the balance including nickel are introduced into a ball mill, for instance, for mixing and crushing of particles of the individual components, and for effecting repeated bonding and plastic deformation of the particles until the powdered mixture is sufficiently alloyed with the matrix phase strengthened by the disperse phase consisting of the finely divided particles of the high-melting point metal oxide or oxides. The thus produced dispersion-strengthened powdered alloy is shaped by a suitable process such as hot extrusion, hot forging, hot rolling or powder metallurgy process, and quenched as needed, to obtain each vane 92, 115.

The vanes 92, 115 formed of the dispersion-strengthened alloy includes the finely divided particles of the high-melting point metal oxide or oxides which are dispersed or distributed as a disperse phase in a nickel-based alloy matrix, namely, austenite matrix phase. Since those metal oxide particles are stable in a severe thermal environment or at an elevated temperature within a heat treating furnace. For example, $Y_2O_3$ will not be decomposed into 2Y and 30, which 30 would react with the matrix phase to produce $TiO_2$ and $Al_2O_3$. Accordingly, the alloy including the disperse phase exhibits sufficiently high mechanical strength over a wide range of temperature, from the room temperature to an elevated temperature within a furnace. In this respect, the present alloy is contrary to a conventional Ni-based alloy including Al and Ti, which is strengthened by precipitating finely divided particles of an intermetallic compound $Ni_3(Al, Ti)$ from a super-saturated solid solution. Although this conventional Ni-based alloy is stable at the room temperature, the mechanical strength of the alloy unfavorably tends to be lowered due to reaction of the precipitates with the matrix phase at an elevated temperature. The present dispersion-strengthened alloy prepared by a mechanical alloying process according to the present invention maintains sufficient strength even at an elevated temperature within a furnace. Consequently, the impeller 76, 114 formed of the dispersion-strengthened alloy exhibits a sufficiently high degree of strength at a temperature of 1200° C. or higher, for example, and is capable of operating at a relatively high speed at such elevated temperature. Accordingly, the gas blower or circulating fan 42 using the impeller 76, 114 has a relatively large capacity without increasing the size of the impeller, whereby the floating conveyor furnace 10 using the circulating fan 42 can be made accordingly compact and small-sized. Further, the impeller 76, 114 has improved shock resistance and operating reliability as compared with a conventional impeller with ceramic vanes.

To confirm the properties of the impellers according to the present invention, experiments were conducted on Examples A through E according to the invention, and Comparative Examples X and Y. In Examples A through E, the vanes of the impeller were formed by hot extrusion using a dispersion-strengthened alloy prepared by a mechanical alloying process. The compositions of the alloy according to these Examples A–E are indicated in TABLE 1 below. Each specimen of the vane, which has a maximum thickness of 20 mm, a width of 200 mm and a length of 300 mm, was fixed to the hub 90 as shown in FIG. 4, and the impeller

TABLE 1

| | Composition of Alloys for vanes (wt.%) | | | | | | | |
|---|---|---|---|---|---|---|---|---|
| Examples | C | Cr | Al | Ti | Fe | Ni | Metal Oxide | |
| INVENTION | | | | | | | | |
| A | 0.05 | 20 | 0.5 | 0.5 | 0.3 | Bal. | $Y_2O_3$ | 0.5 |
| B | 0.05 | 19 | 0.5 | 3.0 | 2.0 | Bal. | $Ce_2O_3$ | 0.8 |
| C | 0.05 | 25 | 4.0 | 1.5 | 1.0 | Bal. | $Y_2O_3$ | 0.7 |
| | | | | | | Bal. | $ZrO_3$ | 0.3 |
| D | 0.05 | 33 | 0.6 | 0.4 | 0.5 | Bal. | $Y_2O_3$ | 0.7 |
| | | | | | | Bal. | $Al_2O_3$ | 0.3 |
| E | 0.05 | 25 | 0.5 | 0.5 | 0.2 | Bal. | $Gd_2O_3$ | 0.5 |
| CP* | | | | | | | | |
| X | Ni-based alloy (19Cr-12Co-6Mo-1W-2Al-3Ti-Bal.Ni) | | | | | | | |
| Y | Ceramic | | | | | | | |

*X and Y are comparative examples.

with the vanes was incorporated in the circulating fan 42 as shown in FIG. 3. The impeller was rotated at 2500 r.p.m. at 1200° C. in a steel heating furnace. The vanes according to Comparative Example X and Y were formed of a Ni-based alloy and a ceramic material, respectively. Test operations of the impeller were continued until the vanes were broken. The service life (in operating hours) of each example is indicated in TABLE 2 below.

TABLE 2

| Examples | Service Life (hr.) |
|---|---|
| INVENTION | |
| A | 2239 |
| B | 2000 |
| C | 1900 |
| D | 2000 |
| E | 2300 |
| CP | |
| X | 50 |
| Y | 1200 (breakage due to dust collision) |

It will be understood from TABLE 2 that the service lives of the specimens according to Examples A through E of the present invention are at least 38 times as long as that of the specimen according to Comparative Example X using the Ni-based alloy for the impeller vanes, and at least 1.58 times as long as that of the specimen according to Comparative Example Y using the ceramic material for the vanes. The vanes of Comparative Example X suffered from considerably early creep rupture due to exposure to high-temperature gas and centrifugal force, and the vanes of Comparative Example Y suffered from breakage which appeared to arise from collision of the vanes with foreign matters such as dust within the furnace.

As is apparent from the result of the experiment described above, the impeller 76 or 114 of the circulating fan 42 not only enjoys shock and heat resistance properties as exhibited by a metallic material, but also show improved properties in terms of strength at an elevated temperature, which have not been exhibited by a conventional metallic impeller.

The circulating fan 42 using the impeller 76, 114 whose vanes 92, 115 are formed of a dispersion-strengthened alloy according to the principle of the present invention can be operated under an atmosphere whose temperature is higher than 1200° C., and exhibits prolonged service life and operating reliability under such severe thermal condition.

Figure 6:
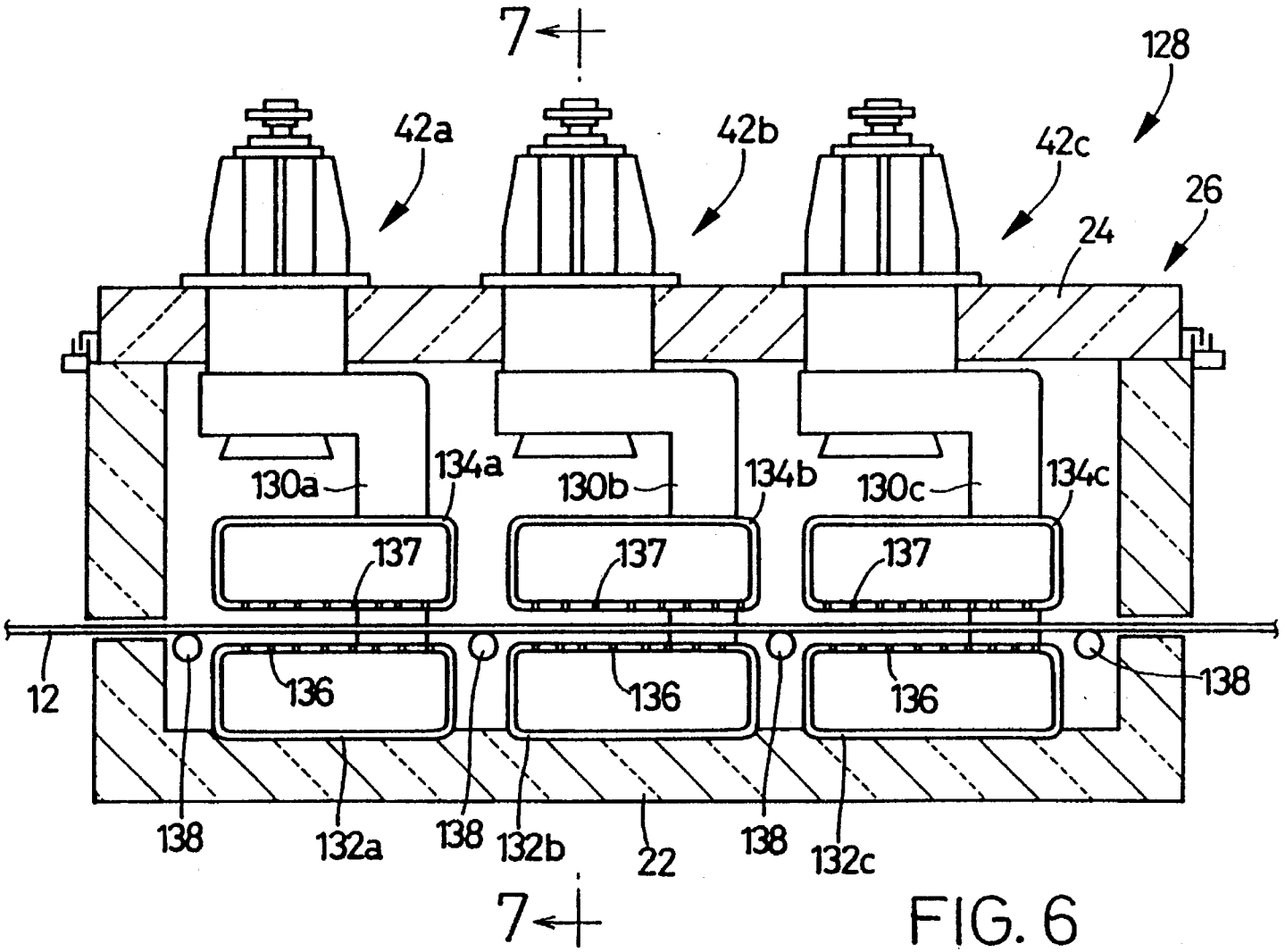
FIG. 6 is a view corresponding to that of FIG. 1, showing a further embodiment of the invention.
Figure 7:
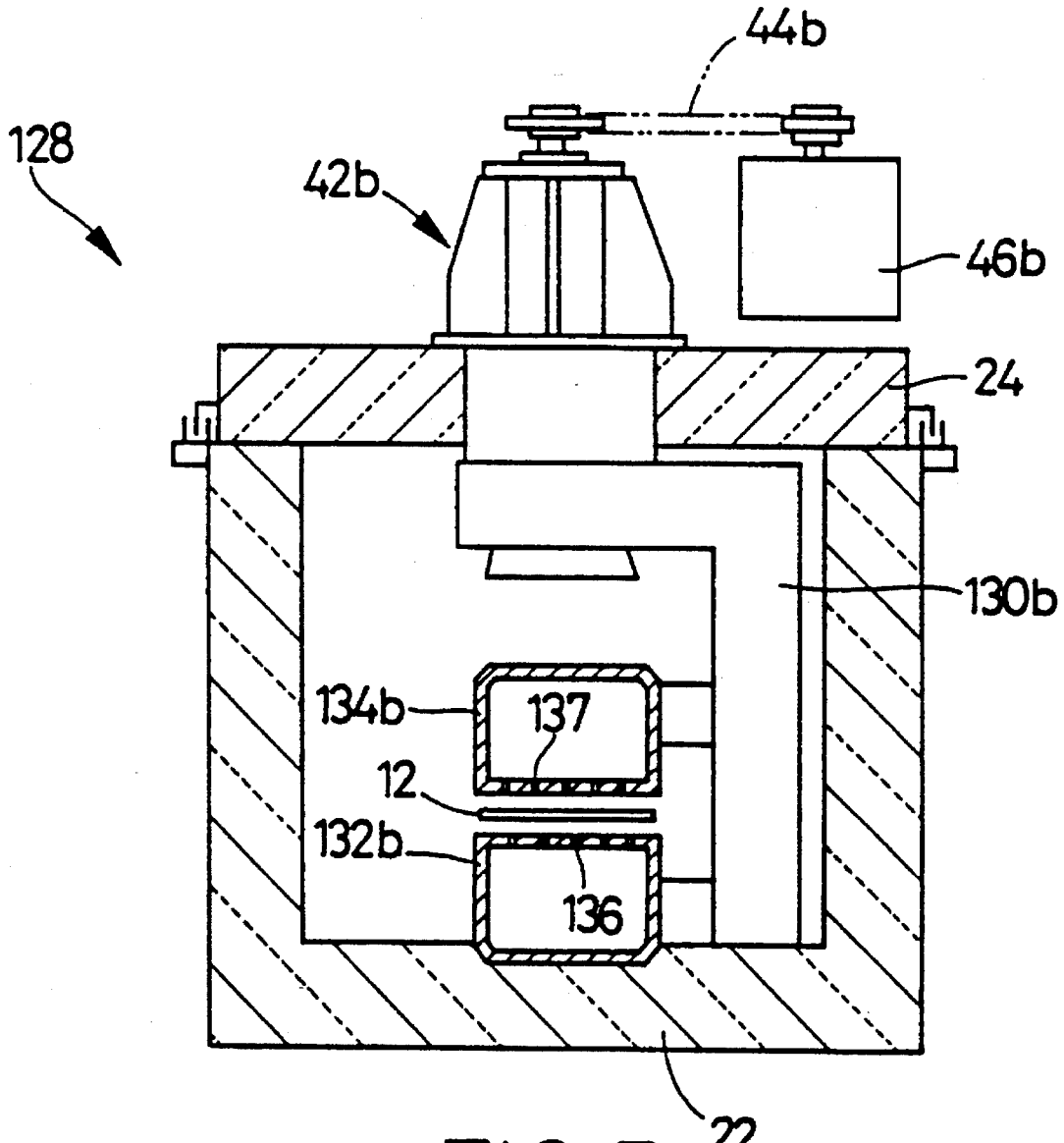
FIG. 7 is a cross sectional view taken along line 7—7 of FIG. 6.

Referring next to FIGS. 6 and 7, there is shown an annealing furnace 128 constructed according to a third embodiment of the present invention, which uses three gas blowers in the form of circulating fans 42*a*, 42*b* and 42*c* fixed to the top wall 24 of the furnace body 26. These fans 42*a*, 42*b*, 42*c* are identical with the fan 42 having the impeller 76, 114 which has been described above by reference to FIGS. 1–5. Within the furnace body 26, there is provided an array of lower nozzle members 132*a*, 132*b* and 132*c* resting on the bottom wall 22. These lower nozzle members 132*a*, 132*b*, 132*c* have respective lower plenum chambers connected to the respective circulating fans 42*a*, 42*b*, 42*c* through the respective ducts 130*a*, 130*b*, 130*c*, as clearly shown in FIG. 7. The nozzle members 132*a*, 132*b*, 132*c* are located a short distance below the feed path of the strip 12 such that the nozzle members 132*a*, 132*b*, 132*c* are spaced apart from each other along the feed path . Further, three upper nozzle members 134*a*, 134*b* and 134*c* having respective upper plenum chambers are disposed a short distance above the feed path of the strip 12 such that the nozzle members 134*a*, 134*b*, 134*c* are opposed to the respective lower nozzle members 132*a*, 132*b*, 132*c*. These upper nozzle members 134*a*, 134*b*, 134*c* are also connected to the respective fans 42*a*, 42*b*, 42*c* through the respective ducts 130*a*, 130*b*, 130*c*.

Each of the lower nozzle members 132*a*, 132*b*, 132 has a plurality of nozzles 136 formed in its upper surface facing the corresponding upper nozzle member 134*a*, 134*b*, 134*c*, while each of the upper nozzle members 134*a*, 134*b*, 134*c* has a plurality of nozzles 137 formed in its lower surface facing the corresponding lower nozzle member 132*a*, 132*b*, 132*c*. The compressed high-temperature gas delivered from the circulating fans 42*a*, 42*b*, 42*c* to the lower and upper plenum chambers through the respective ducts 130*a*, 130*b*, 130*c* are blown through the nozzles 136, 137 toward the opposite surfaces of the strip 12, whereby the strip 12 is supported in non-contact or floating fashion. Rollers 138 for supporting the strip 12 while the fans 42*a*–42*c* are at rest may be provided within the furnace body 26.

Figure 8:
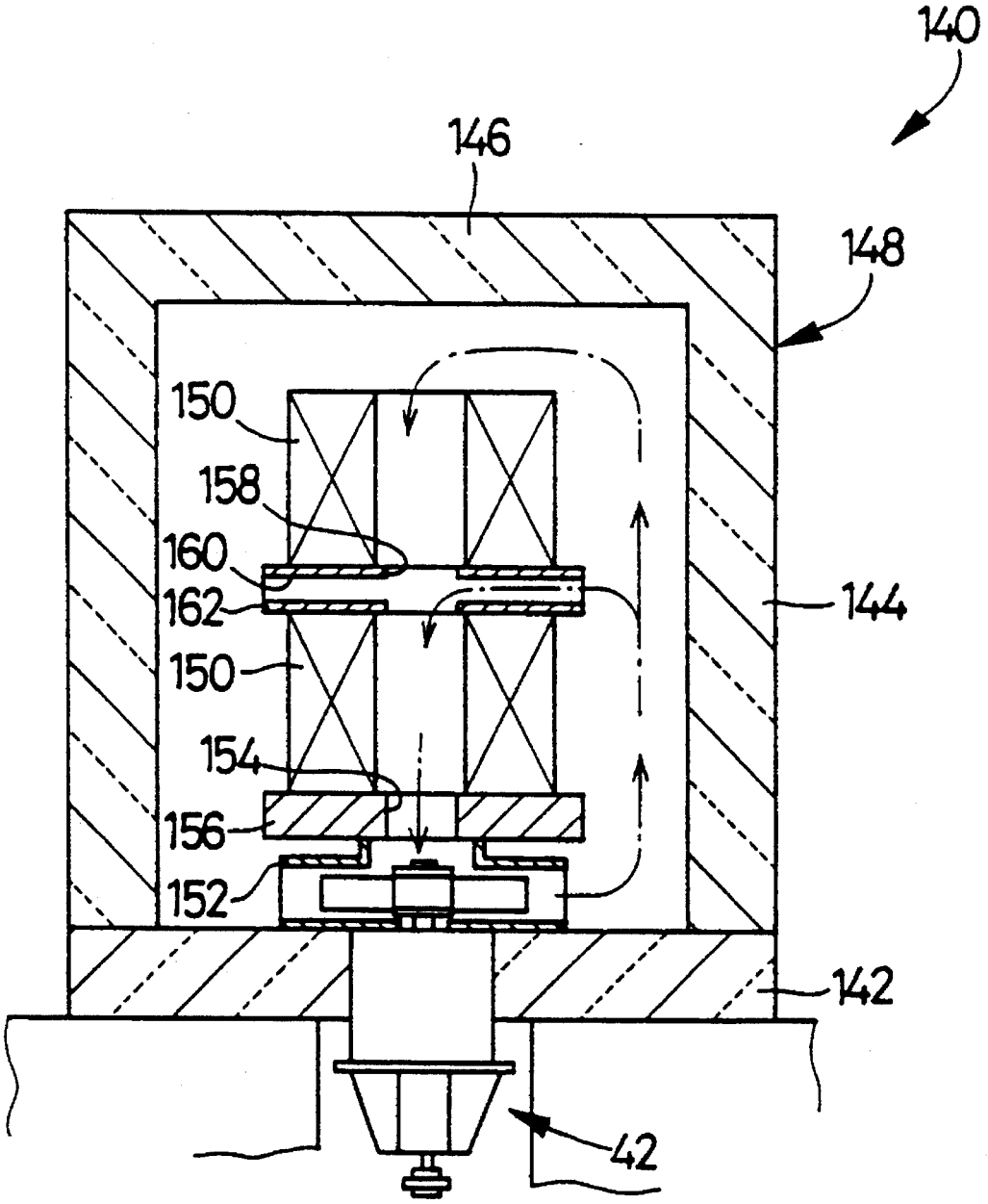
FIG. 8 is a view corresponding to that of FIG. 2, showing a yet further embodiment of the invention.

The present invention may also be embodied as a bell type furnace 140 as shown in FIG. 8, which uses the circulating fan 42 secured to a stationary bottom wall 142. The bottom wall 142 cooperates with side walls 144 and a top wall 146 to define a heating chamber. The side wall 144 and the top wall 146 constitute a movable rectangular box structure 148 which rests on the bottom wall 142 when the furnace 140 is in operation for heating the workpiece in the form of coils of strip or wire 150. When the furnace 140 is loaded and unloaded with the coils 150, the box structure 148 is lifted and lowered by a crane, to be placed on and removed from the bottom wall 142. The circulating fan 42 has a casing 152 in abutting contact with the upper surface of the bottom wall 142. On this casing 152, there is disposed a platform 156 which has a central through-hole 154 communicating with the casing 152 of the fan 42. In the present embodiment, two coils 150 are placed on the platform 156 such that the central openings of the coils 150 are aligned with the central through-hole 154 of the platform 156. An annular spacer 162 is placed on the upper end of the lower coil 150, so that the upper coil 150 rests on the spacer 162. This spacer has a central opening 158 to be aligned with the central openings of the coils 150, and a plurality of radial communication passages 160 which communicate at their inner ends with the central opening 158 and at their outer ends with the interior of the heating chamber. The high-temperature gas delivered from the casing 152 of the operating fan 42 is circulated within the heating chamber as indicated by arrowed one-dot chain lines in FIG. 8.

While the present invention has been described in detail in its presently preferred embodiments, by reference to the accompanying drawings, for illustrative purpose only, it is to be understood that the present invention is not limited to the details of the illustrated embodiments, but may be otherwise embodied.

For example, the number and configuration of the vanes 92, 115 fixed to the hub 90 of the impellers 76, 114 of the circulating fan 42 may be changed or modified as needed. The hub 90 may also be formed of a dispersion-strengthened alloy, and may be formed integrally with the vanes 92, 115.

Although the circulating fan 42 has the specific construction as described above, the principle of the present invention is equally applicable to any other types of high-temperature gas blowers such as schirokko (scirocco) fan and turbo fan, provided such fan or blower has a plurality of vanes or blades arranged around the axis of the drive shaft or spaced from each other in the circumferential direction of a hub to which the vanes are fixed so as to extend in the radial direction of the hub.

While the annealing furnace 128 of FIGS. 6 and 7 is adapted to feed the strip 12 in the horizontal direction, the furnace may be modified to feed the strip 12 in the vertical direction.

In the embodiment of FIG. 8, the circulating fan 42 used with the bell type furnace 140 is arranged to circulate the high-temperature gas through a path which is partially defined by the central openings of the coils 150. However, the fan 42 may be fixed to the top wall 146 to merely stir the high-temperature gas within the furnace 140.

It is to be further understood that the present invention may be embodied with various other changes, modifications and improvements, which may occur to those skilled in the art, in the light of the foregoing teachings, and without departing from the spirit and scope of the invention defined in the following claims. For instance, the floaters 28, 30, 32 provided within the furnace 10 and the portions of the fan 42 other than the impeller 76, 114 may be modified as desired.

What is claimed is:

1. An impeller for a high-temperature gas blower, rotated to blow a high-temperature gas, comprising a plurality of vanes comprising an alloy and 0.1–2.0% by weight of finely divided particles of a metal oxide having a high melting point dispersed in said alloy.

2. An impeller according to claim 1, wherein said vanes comprise 0.1–2.0% by weight of said metal oxide, 18–40% by weight of Cr, not more than 5% by weight of Fe, not more than 5% by weight of Al, not more than 5% by weight of Ti and the balance including Ni as a major element, wherein said Cr, Fe, Al and Ti and said balance constitute an austenite matrix phase in which said finely divided particles are dispersed.

3. An impeller according to claim 2, wherein said vanes are formed by repeated bonding and plastic deformation of particles of said metallic elements Cr, Fe, Al, Ti and Ni and said particles of said metal oxide, while being subjected to mixing and crushing in a ball mill.

4. An impeller according to claim 3, wherein said plurality of vanes are formed by hot extrusion.

5. A high-temperature gas blower having an impeller rotated to blow a high-temperature gas, said impeller comprising a plurality of vanes comprising an alloy and 0.1–2.0% by weight of finely divided particles of a metal oxide having a high melting point dispersed in said alloy.

6. A high-temperature gas blower according to claim 5, wherein said vanes comprise 0.1–2.0% by weight of said metal oxide, 18–40% by weight of Cr, not more than 5% by weight of Fe, not more than 5% by weight of Al, not more than 5% by weight of Ti and the balance including Ni as a major element, wherein said Cr, Fe, Al and Ti and said balance constitute an austenite matrix phase in which said finely divided particles are dispersed.

7. A high-temperature gas blower according to claim 6, wherein said vanes are formed by repeated bonding and plastic deformation of particles of said metallic elements Cr, Fe, Al, Ti and Ni and said particles of said metal oxide, while being subjected to mixing and crushing in a ball mill.

8. A high-temperature gas blower according to claim 7, wherein said plurality of vanes are formed by hot extrusion.

9. A high-temperature gas blower according to claim 5, further comprising a motor and a drive shaft rotated by said motor, and wherein said impeller further comprises a cylindrical hub fixed to an end portion of said drive shaft, said plurality of vanes consisting of a plurality of generally elongate plates which are fixed to said hub so as to extend radially of said hub such that said vanes are equally spaced apart from each other in a circumferential direction of said hub.

10. A high-temperature gas blower according to claim 9, wherein each of said generally elongate plates has a fixed end portion at which said each plate is fixed to said hub, said fixed end portion having protrusions which protrude away from each other from planes of opposite major surfaces of the other portion of said each plate, in a direction of thickness of said each plate, said hub having a plurality of grooves corresponding to said plurality of generally elongate plates, each of said grooves having a shape similar to that of said fixed end portion, said plates being fixed to said hub such that said fixed end portion of said each plate is fixedly received in a corresponding one of said grooves.

11. A high-temperature gas blower according to claim 9, further comprising a cylindrical bearing housing having an annular cooling jacket through which a coolant is circulated, and a pair of bearings supported in said bearing housing, said drive shaft being rotatably supported by said pair of bearings such that said drive shaft extends through said bearing housing in an axial direction thereof.

12. An impeller for a high-temperature gas blower, rotated to blow a high-temperature gas, comprising a plurality of vanes comprising an alloy and 0.1–2.0% by weight of finely divided particles of a metal oxide having a high melting point dispersed in said alloy, and where said metal oxide is selected from the group consisting of $Y_2O_3$, $Ce_2O_3$, $ZrO_2$, $Al_2O_3$ and $Gd_2O_3$.

13. A high-temperature gas blower having an impeller rotated to blow a high-temperature gas, said impeller comprising a plurality of vanes comprising an alloy and 0.1–2.0% by weight of finely divided particles of a metal oxide having a high melting point dispersed in said alloy, and where said metal oxide is selected from the group consisting of $Y_2O_3$, $Ce_2O_3$, $ZrO_2$, $Al_2O_3$ and $Gd_2O_3$.

* * * * *